United States Patent [19]

Greenwood et al.

[11] Patent Number: 4,658,775

[45] Date of Patent: Apr. 21, 1987

[54] ROPE STARTER FOR ENGINES

[75] Inventors: Leon D. Greenwood, Okemos; Thomas A. Thorsen, Eaton Rapids, both of Mich.

[73] Assignee: Eaton Stamping Company, Eaton Rapids, Mich.

[21] Appl. No.: 812,362

[22] Filed: Dec. 23, 1985

[51] Int. Cl.[4] ..... F02N 3/02

[52] U.S. Cl. ..... 123/185 B; 123/185 G; 74/6

[58] Field of Search ..... 123/185 A, 185 B, 185 BA, 123/185 G, 179 SE; 74/6

[56] References Cited

U.S. PATENT DOCUMENTS

| | | | |
|---|---|---|---|
| 3,134,376 | 5/1964 | Rice | 123/185 BA |
| 3,375,813 | 4/1968 | Hamman | 123/185 |
| 3,465,740 | 9/1969 | Harkness et al. | 123/185 |
| 3,827,307 | 8/1974 | Couchman, Jr. | 74/6 |
| 3,906,921 | 9/1975 | Tillotson et al. | 123/179 K |
| 3,942,505 | 3/1976 | Tillotson | 123/179 K |
| 4,167,929 | 9/1979 | DuBois | 123/179 K |

FOREIGN PATENT DOCUMENTS

| | | | |
|---|---|---|---|
| 57-186059 | 11/1982 | Japan | 123/185 BA |

*Primary Examiner*—Andrew M. Dolinar
*Attorney, Agent, or Firm*—Beaman & Beaman

[57] ABSTRACT

A rope-operated recoil starter particularly suitable for use with lawn mowers having the starter rope handle mounted upon the mower handle. The starter structure is the Bendix type having an engine flywheel engagable gear axially translatable upon the rope pulley. A friction brake member associated with the gear produces the gear axial translation. Lost motion means automatically operate the friction brake for producing a delay in gear translation with respect to pulley rotation preventing inadvertent gear-flywheel engagement due to mower handle movement. Additionally, a positive lockout associated with the friction brake member prevents engagement of the gear with the flywheel except during rotation of the rope pulley in an engine cranking direction. The rope pulley is provided with a rope storage ledge for accommodating the extra rope necessary to permit the rope handle to be mounted on the mower handle, and to provide extra rope for cranking, if desired.

9 Claims, 7 Drawing Figures

ROPE STARTER FOR ENGINES

BACKGROUND OF THE INVENTION

Small internal combustion engines such as commonly used on lawn mowers and the like often utilize rope-operated recoiling starters. Such starters basically include a pulley upon which a starter rope is wound, a driving member or gear associated with the pulley which engages engine flywheel structure when the pulley is rotated in an engine cranking direction, and a recoil spring associated with the pulley to automatically rewind the rope thereon upon releasing the rope tension.

A wide variety of rope-operated recoil starters have been produced, and a popular construction has been a starter of the Bendix type wherein a bracket is mounted upon the engine adjacent the engine flywheel supporting a shaft upon which a rope pulley is rotatably mounted. The pulley includes a groove receiving a rope wound therein, and the pulley structure includes a hub having a helical or spiral spline or thread defined thereon. A driving member in the form of a gear is mounted upon the hub and includes a bore having spiralled splines complementary to those of the pulley hub. The periphery of the gear includes clutch structure, usually gear teeth, engagable with clutch structure, often gear teeth, defined on the engine flywheel upon translation of the gear between a retracted position and a cranking position. Axial translation of the gear between the retracted and cranking positions is controlled by a friction brake tending to retard rotation of the gear. As the retarding of gear rotation produces relative rotation between the pulley and the gear, the friction brake controls the axial translation of the gear on the pulley hub.

Examples of the aforedescribed type rope recoil starter are shown in U.S. Pat. Nos. 3,375,813; 3,465,740; 3,827,307; 3,906,921; 3,942,505 and 4,167,929.

The friction brake associated with the driving member or gear often consists of a resilient wire embracing a groove defined in the gear. A radial extension formed on the brake engages a fixed abutment usually defined on the mounting bracket and the friction brake is restrained against rotation whereby the gear will be continually restrained against rotation during all of the starter cycles of operation. U.S. Pat. No. 3,827,307 discloses a brake operator which reduces the frictional braking action at predetermined angular positions of the brake.

Due to the heavy vibration present in a small internal combustion engine, the vibration may cause the starter gear to rotate or "creep" relative to the pulley hub during normal engine operation. This gear rotation is due to the vibration overcoming the resistance to gear rotation produced by the friction brake, and the gear may axially translate on the pulley hub sufficiently to inadvertently contact the rotating engine flywheel starter clutch or gear teeth, with the possibility of damaging or excessively wearing the flywheel or starter components. Lockout means for the gear to prevent engagement with the engine flywheel are shown in U.S. Pat. Nos. 3,906,921 and 3,942,505, but such lockout structure is for the purpose of preventing starter operation when the lawn mower wheel drive apparatus is in engagement, and such lockout apparatus as shown in these patents will not prevent "creep" of the gear due to engine vibration, when drive is not engaged.

For safety purposes it is now required in some jurisdictions that rotary lawn mowers mount the engine starter rope handle on the mower handle. Such location of the starter rope handle requires that the operator stand behind the mower handle remote from the mower engine and blade during starting. As such an installation requires the starter rope to extend from the engine to the mower handle several problems are produced not previously encountered with conventional starter installations wherein the rope handle is located adjacent the engine and engine-mounted starter structure. For instance, lawn mower handles are usually capable of limited pivotal movement with respect to their connection to the mower deck and such pivotal mower handle movement will produce tension, or slack, in the starter rope mounted thereon. Thus, a pivoting of the mower handle which tensions the starter rope would produce movement of the starter gear toward the engine flywheel causing engagement therebetween while the flywheel was rotating.

Another problem created by the mounting of the starter rope handle upon a lawn mower handle results from the need for a greater length of starter rope than previously required in that the rope handle is now located at a considerable distance from the starter pulley. As starters and engines are usually sold to lawn mower manufacturers as an assembled unit, the extra rope required creates a problem prior to the rope handle being mounted on the lawn mower handle and handling, painting and assembly difficulties have been encountered.

One approach toward overcoming the problems relative to mounting the starter rope handle on the lawn mower handle has been to locate a knot, or other abutment, on the starter rope for engagement with a stop after a predetermined recoiling of the starter rope upon its pulley has occurred. This restraint of the recoiling of the starter rope permits slack to exist between the starter and the starter rope handle so that the pivotal movement of the lawn mower handle does not produce a rotation of the rope pulley. However, this solution to the problem results in an unsightly and loose starter rope, increases the likelihood of starter rope kinking and damage thereto, and complicates the assembly or replacement of the starter and starter rope on the lawn mower.

It is an object of the invention to provide a rope recoil starter particularly suitable for lawn mower use where the rope pull handle is mounted upon the lawn mower handle wherein a delay exists in the axial translation of the driving element or gear toward the engine flywheel after the initial rotation of the rope pulley in a cranking direction.

Another object of the invention is to provide a rope recoil starter of the Bendix type utilizing a friction brake to axially translate a starter gear wherein lost motion means are associated with the friction brake to delay translation of the gear toward the engine starting structure during rotation of the rope pulley in a cranking direction.

An additional object of the invention is to provide a rope recoil starter of the Bendix type having a positive gear lockout preventing inadvertent engagement of the starter gear and engine starting structure due to movement of the gear due to engine vibration.

A further object of the invention is to provide a rope recoil starter having a rope wound upon a pulley wherein access to the rope inner end is provided to simplify rope replacement.

Another object of the invention is to provide a rope recoil starter pulley of such configuration wherein the pulley includes rope storage structure upon which extra rope may be wound during handling and shipping of the starter and associated engine to simplify assembly of the starter components to the handle of a lawn mower, and also, provide extra rope for cranking, if desired.

Yet another object of the invention is to provide a rope recoil starter including a rope pulley mounted upon a shaft wherein a shaft mounted cover functions to enclose a pulley recoil spring and includes a cylindrical skirt disposed over the rope receiving groove and a pulley storage portion for excess rope to improve confinement and alignment of the starter rope upon the pulley.

In the practice of the invention a sheet metal bracket is mounted upon the internal combustion engine adjacent the engine flywheel. A shaft is supported upon the bracket at one end, and a rope pulley is rotatably mounted upon the shaft. The rope pulley includes a radial rope receiving groove in radial alignment with the outer region of the shaft, and a pulley hub surrounds the majority of the shaft and is located between the rope groove pulley portion and the bracket. Helically spiralled splines are defined on the outer surface of the pulley hub.

An annular cover is mounted upon the outer end of the shaft and includes a radial wall encompassing a spiral spring, one end of which is attached to the cover, and the other end is affixed to the pulley for rotating the pulley in the rope recoiling direction. The rope groove is of a width substantially equal to the diameter of the rope, and at its outer region, the rope groove includes a cylindrical land upon which excess rope may be wound prior to completion of the assembly of the starter with the lawn mower with which it is associated.

A driving member in the form of a gear is mounted upon the pulley hub, and the gear bore is provided with helical splines complementary to those defined on the pulley hub wherein relative rotation between the gear and hub axially translates the gear between a retracted position and an extended engine cranking position. Teeth defined on the gear periphery are adapted to engage gear teeth defined on the engine flywheel upon the gear being located in the cranking position.

A friction brake formed of wire embraces a groove defined on the gear. The friction brake includes a radial extension, and the purpose of the brake is to retard rotation of the gear to produce relative rotation between the pulley and gear to axially translate the gear.

A pair of stops or abutments are defined on the starter bracket radially spaced from the shaft and are located, in the disclosed embodiment, at substantially diametrically opposed positions with respect to the shaft. The abutments are formed from the metal of the bracket, and are located relative to the shaft for engagement with the brake radial extension. The brake extension is located between the abutments for rotation or oscillation therebetween, rotation of the rope pulley in one direction causing the extension to engage one abutment, while rotation of the pulley in the opposite direction causing the friction brake extension to engage the other abutment. The friction brake will rotate through approximately 180° between engagement with the abutments.

The starter mounting brakcet is also provided with a lockout ridge which is defined of the metal of the bracket. The ridge is of an arcuate configuration substantially extending between the brake extension engaging abutments and in axial alignment with the abutment movement whereby the brake abutment will engage the ridge during much of its movement, and such engagement will prevent axial displacement of the gear toward the engine flywheel. The ridge defined on the bracket terminates short of the abutment engaged by the brake extension when the pulley is rotated in the engine cranking direction for permitting the gear to move into engagement with the teeth of the engine flywheel and produce cranking. When the pulley is rotated in the recoil direction, axial movement of the gear toward its retracted position lifts the brake extension permitting the extension to rotate over an end of the ridge as the pulley continues to rotate in the recoil direction.

The cover mounted upon the end of the shaft includes a cylindrical skirt at its periphery which axially extends over the pulley rope groove and rope storage land. The cover skirt includes an opening through which the rope extends, but as the skirt encompasses the majority of the circumference of the pulley it confines the rope within the pulley and minimizes rope groove and rope alignment problems during recoiling, especially if the tension on the rope has been excessively released during recoiling.

The aforementioned features permit a delay in the gear movement with respect to rotation of the starter pulley, and such delay prevents inadvertent starter and flywheel engagement due to pivoting of the lawn mower handle. The use of the ridge prevents inadvertent engagement of the starter gear and flywheel due to vibration, and these important features of the invention can be produced without requiring expensive and complex machine or assembly techniques.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
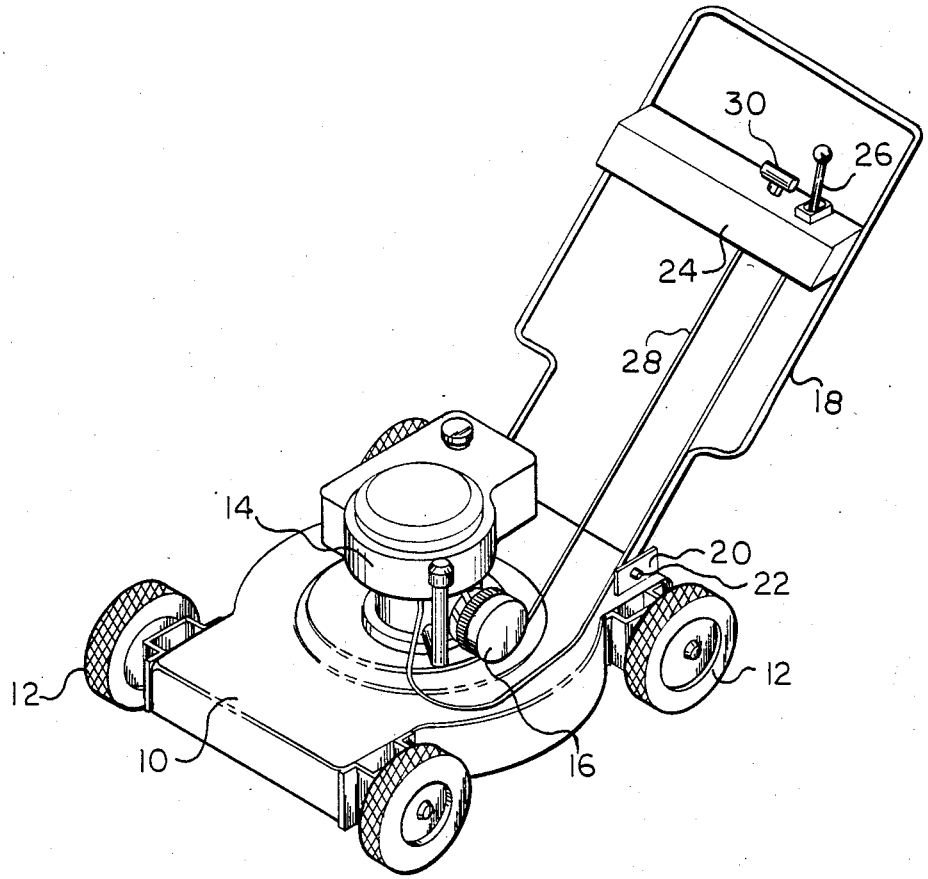
FIG. 1 is a perspective view of a rotary lawn mower using a rope recoil starter in accord with the invention.

A typical rotary lawn mower installation in which the starter of the invention is employed is illustrated in FIG. 1. The lawn mower includes a horizontal deck 10 supported upon wheels 12. An internal combustion engine 14 of the vertical crankshaft type is mounted upon the deck, and a rotary blade, not shown, is affixed to the lower end of the crankshaft below the deck. A starter 16 of the rope recoil type is affixed to the side of the engine 14 and the lawn mower includes a handle 18 pivotally mounted to the mower deck by brackets 20 and pivot pins 22. Restraining means, not shown, are associated with the brackets for limiting the pivotal adjustment of the handle 18. The handle 18 includes a control console 24 affixed thereto and the console includes a throttle lever 26 connected to the engine through a cable control, and the starter rope 28 extends to the console having its outer end attached to the rope handle 30 which engages the console when the starter rope is recoiled. Accordingly, it will be appreciated that the operator may stand behind the mower handle 18 and pull the starter rope by means of the handle 30, and as the operator will be remotely located with respect to the engine and blade, safety precautions are observed.

Figure 2:
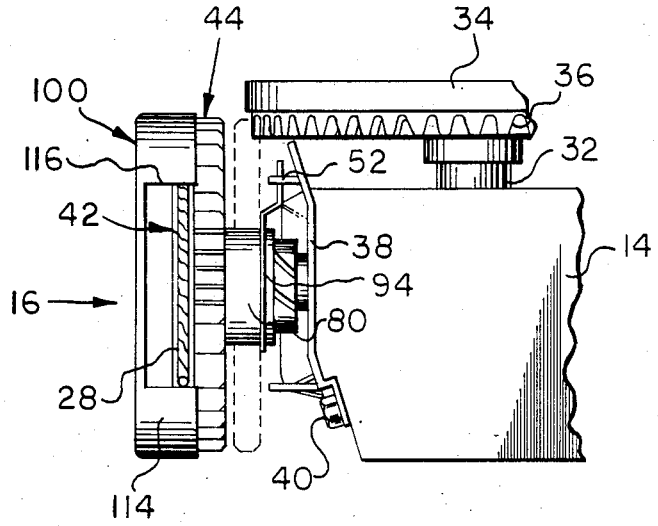
FIG. 2 is a detail, enlarged, elevational view of the flywheel and starter relationship, the position of the starter gear during cranking being shown in dotted lines.

In FIG. 2 the relationship of the starter and engine flywheel is illustrated, portions of the engine and engine components being omitted for purpose of clarity. For instance, the engine will include a flywheel housing or shroud disposed over the flywheel. The engine 14 includes the crankshaft 32, the upper end of which supports the flywheel 34. At its lower region, the flywheel is provided with gear teeth 36 for engagement with the starter gear, as later explained.

The starter mounting bracket 38 is attached to the side of the engine 14 by bolts 40, and the starter includes a rope pulley 42 and a driving member gear 44 mounted upon the pulley hub is axially translatable between the full-line position shown in FIG. 2 wherein the gear is retracted from the flywheel 34, and moves into engagement with the flywheel teeth 36 as shown in dotted lines in FIG. 2 during rotation of the rope pulley in an engine cranking direction.

With reference to FIGS. 3–7, the details of the starter in accord with the invention will be appreciated.

Figure 3:
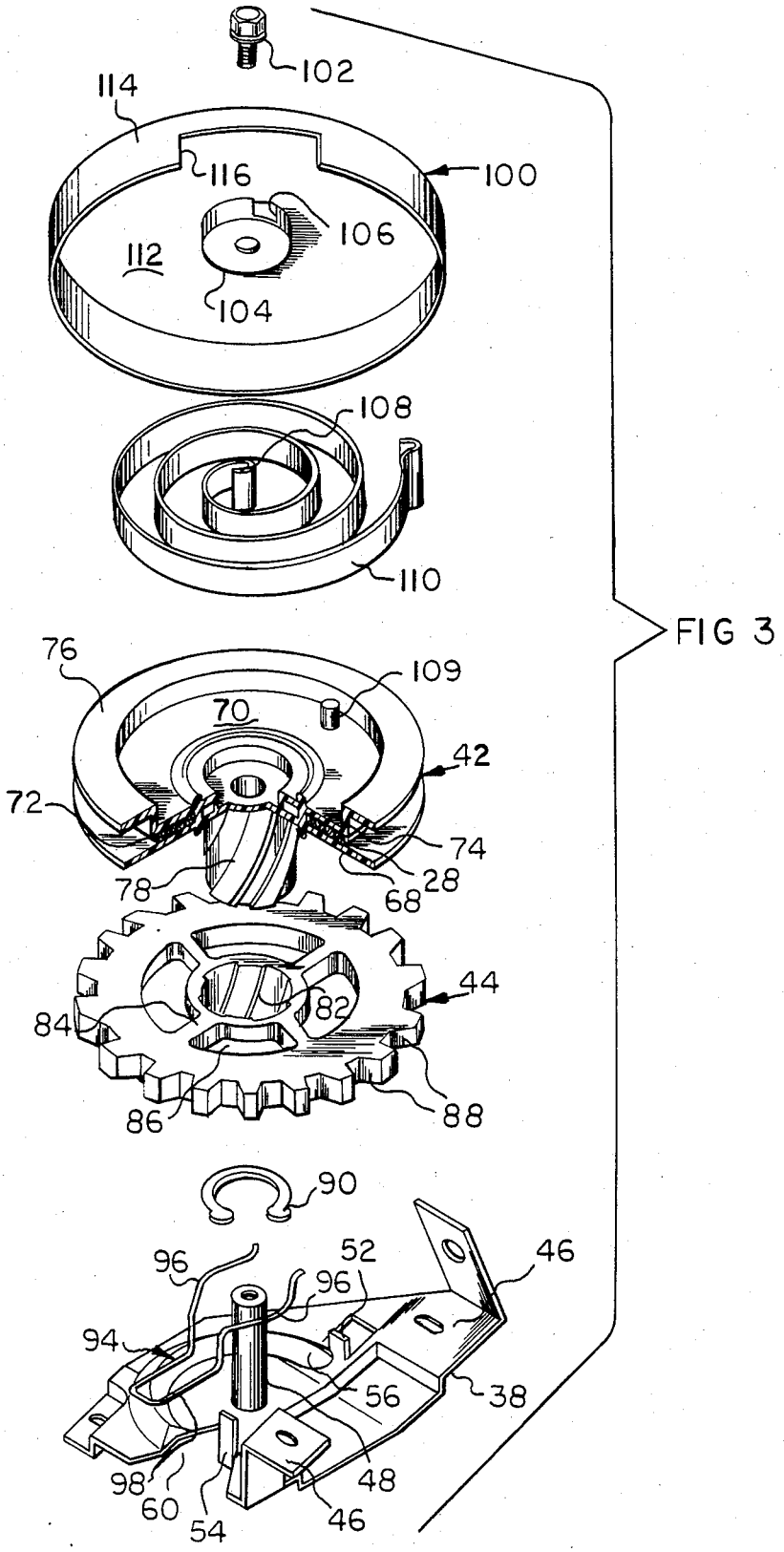
FIG. 3 is a perspective, exploded view of a starter constructed in accord with the invention illusstrating the primary components thereof.

The starter mounting bracket 38 is formed of sheet metal, and is of a complex configuration best appreciated from FIG. 3. The bracket includes three mounting flats 46 having holes defined therein for receiving mounting bolts 40 for attaching the starter to the engine. A cylindrical shaft 48 extends through the mounting bracket 38 and is firmly affixed thereto at the shaft head 50. The outer end of the shaft is provided with an axial threaded bore. The bracket 38 includes an abutment stop tab 52 lanced from the material of the bracket, and a second stop abutment 54 is also defined on the bracket on the opposite side of the shaft 48 as will be appreciated from FIG. 6. The stop abutments extend from the bracket in the same direction as the shaft.

Figure 6:
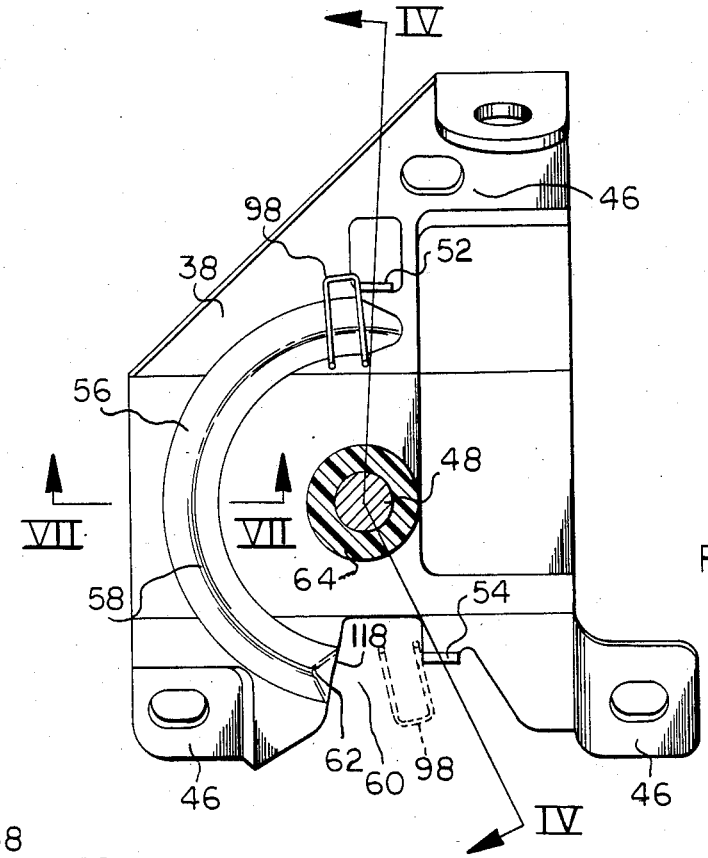
FIG. 6 is a sectional view illustrating the starter mounting bracket as taken along Section VI—VI of FIG. 4.
Figure 7:
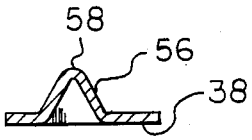
FIG. 7 is a detail, enlarged, elevational, sectional view taken through the mounting plate ridge along Section VII—VII of FIG. 6.

Additionally, an inverted V-shaped ridge 56 is defined on the bracket 38 substantially concentric to the shaft 48, as best appreciated from FIGS. 6 and 7. The ridge 56 includes an apex 58 extending in the direction of extension of the shaft, and the ridge extends to the stop abutment 52 as appreciated in FIG. 6. At its other end, the ridge 56 terminates at the bracket notch 60, and at this terminating end the ridge apex is slightly beveled as at 62. The bracket clearance notch 60 is intersected by the ridge 56, and the notch is adjacent the stop abutment 54 as will be appreciated from the drawing.

Figure 4:
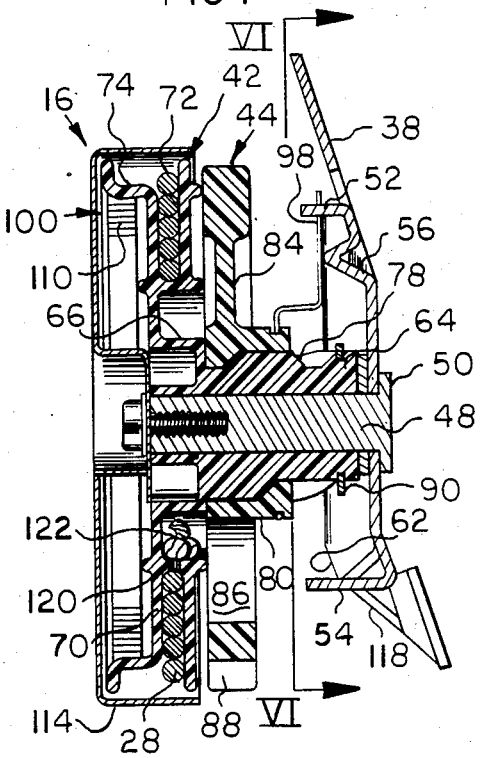
FIG. 4 is an elevational, sectional view as taken through a starter in accord with the invention along Section IV—IV of FIG. 6, illustrating the starter gear in the retracted position.
Figure 5:
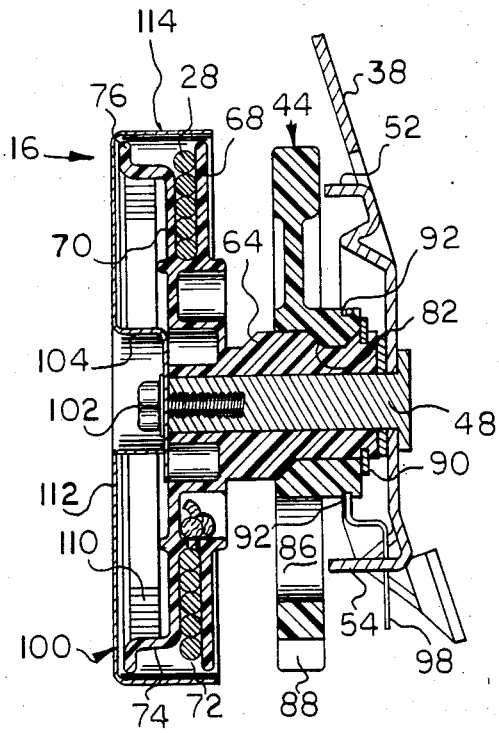
FIG. 5 is an elevational, sectional view similar to FIG. 4 illustrating the starter gear in the cranking position.

The rope pulley 42, and the gear 44, are preferably formed of synthetic plastic material of a high mechanical strength having self-lubricating characteristics such as nylon or the like and as appreciated from FIGS. 3–5, the rope pulley includes a hub 64 from which radially extends the rope receiving portion 66. The rope receiving portion is defined by parallel radial sides 68 and 70 spaced apart a distance substantially equal to the diameter of the rope 28 to define the rope groove 72 wherein the rope will lie upon itself in the groove in single spiralled layers. The pulley side 70 includes a cylindrical axially extending land 74 terminating in a radially extending flange 76 whereby the land provides for storage of additional rope as will be later described.

The pulley hub 64 encompasses the majority of the length of the shaft 48 and has an exterior surface formed with helically spiralled splines 78 upon which the gear 44 is supported. The gear 44 includes a hub 80 having a bore containing helically spiralled splines 82 complementary to those of the pulley hub, and in this manner, the gear is rotatably mounted upon the pulley hub 64. The gear 44 also includes a web 84 having openings 86 defined therein, and at its periphery the gear is provied with teeth 88 complementary to the flywheel gear teeth 36. The snap ring 90 located with a groove upon the pulley hub limits movement of the gear 44 to the right, as viewed in FIGS. 4 and 5. The gear hub 80 is provided with an annular groove 92 which is embraced by a friction brake member 94 formed of rigid wire and of a configuration best appreciated from FIG. 3. The friction brake 94 includes gear groove embracing portions 96, and an extension 98 which extends downwardly, FIG. 3, from the plane of the portions 96 toward the mounting bracket 38.

The basic relationship of many of the components of the instant invention are similar to those shown in the assignee's U.S. Pat. No. 3,375,813, and the invention is an improvement over this prior patent.

A sheet metal cover 100 is fixed to the outer end of the shaft 48 by bolt 102. The cover 100, internally, includes a generally circular spring anchor 104 having an inwardly deformed portion providing an edge 106 around which the bent inner end 108 of the recoil spring 110 passes. The outer end of the spring is attached to the rope pulley 42 at pin 109. The cover 100 includes a radial wall 112 which encloses the recoil spring 110 which is also located adjacent the pulley side 70, and at its outer periphery the cover is provided with a cylindrical skirt 114 extending in an axial direction over the pulley portion 66 and closely circumferentially encompassing the rope groove 72 and the pulley land 74. The cover skirt is provided with an opening 116, FIG. 2, through which the starter rope extends.

Initially, the starter components will be in the position shown in FIGS. 2 and 4 which is the retracted position of the gear 44, and is the position the components assumed at the termination of the pulley recoil cycle. In such instance, the friction brake extension 98 will be as shown in full lines in FIG. 6 in engagement with the stop abutment 52 and overlying the ridge 56 as apparent in FIG. 4. Because the extension 98 will be superimposed "above" or to the left of the ridge 56, the engagement of the extension with the ridge apex 58 will prevent the gear 44 from moving toward the right and toward the engine flywheel 34. Thus, it will be appreciated that the ridge 56 and friction brake extension 98 define a positive lock preventing the gear 44 from moving toward the engine flywheel due to engine vibration.

To start the engine the operator pulls the rope handle 30 tensioning the rope 28. In the known manner, the pulley 42 will be rotated in a counterclockwise direction, FIG. 6, and the initial rotation of the rope pulley will cause the brake extension 98 to move away from the stop abutment 52 in a counterclockwise direction following the contour of the ridge 56. Accordingly, it will be appreciated that during the initial rotation of the rope pulley 42 throughout approximately 180° that the friction brake extension 98 will not be restrained against movement and the gear 44 will rotate with the pulley 42 with no axial gear displacement occurring.

After the pulley 42 and gear 44 have rotated approximately 180° the brake extension 98 will engage the stop abutment 54, as shown in dotted lines in FIG. 6, restraining the friction brake 94 against further rotation with the pulley and gear. This restraint of the friction brake likewise restrains the gear 44 against rotation which produces an axial displacement of the gear on the pulley hub 64 toward the right, FIGS. 4 and 5, and toward the flywheel 34. This axial displacement of the gear is unimpeded in that the brake extension 98 is now in alignment with the bracket notch 60, and the ridge 56 no longer restrains the gear 44 against axial movement. Accordingly, the gear 44 will move toward the flywheel 34 to the engaged or cranking position shown in FIG. 5, wherein the gear teeth 88 engage the flywheel teeth 36, as shown in the dotted lines in FIG. 2, and engine cranking occurs. Upon the engine starting, the flywheel 34 will rotate the gear 44 on the pulley hub to move the gear out of engagement with the flywheel, and the operator will release the tension on the starter rope permitting the rope pulley 42 to recoil under the influence of recoil spring 110.

As the pulley recoils, the friction brake extension will move in the notch 60 toward the ridge 56 and engage the ridge edge 118. This frictional resistance imposed upon the gear 44 insures the gear axial movement which "lifts" the extension 98 over the ridge as aided by the bevel 62, and the extension 98 will then move over the ridge 56 and engage the stop abutment 52 completing retraction of the gear to the position of FIG. 4. The rope continues to recoil and the gear continues to rotate, but with no further axial translation of the gear. If the engine did not start with the first pull of the rope, the starting cycle will be repeated.

The use of the two stop abutments 52 and 54, and the fact that the initial approximate 180° rotation of the rope pulley 42 in the cranking direction produces no axial displacement of the gear 44 produces a lost motion or delay in the gear movement which will prevent inadvertent engagement of the starter gear and the engine flywheel gear teeth due to pivoting of the lawn mower handle 18 during mower operation. Yet the described construction and operation permits the starter rope to be relatively taut between the starter 16 and the handle 18 and starter rope slack during mower operation is eliminated.

The engines for lawn mowers are separately shipped from the engine manufacturer to the lawn mower manufacturer or assembler, and, usually, the starter 16 has already been assembled to the engine 14. The use of the pulley land 74 permits sufficient rope to be wound on the pulley 42 to provide the length necessary for attaching the rope handle 30 to the lawn mower handle console 24 when the engine is mounted on deck 10. As the land is located at the outer region of the pulley groove 72, no special operation is required by those assembling the engine and lawn mower components, and the use of the land 74 eliminates the need to accurately determine the rope length for a variety of lawn mower models.

As the ridge 56 extends through a substantial angular portion about the shaft 48 the ridge will prevent the gear 44 from axially moving toward the flywheel 34 even though vibration partially rotates the gear and rope pulley, and as a positive engagement between the brake extension 98 and the ridge 56 occurs, the gear is positively held against axial movement until the brake extension is in alignment with the bracket notch 60.

The inner end of the rope 28 extends through an opening 120 in the pulley whereby the rope is knotted at 122 in the known manner. As the gear web 84 is provided with openings 86, access to the knot 122 is possible, as will be appreciated from FIG. 4, and such access simplifies replacement of the starter rope, which is often necessary during the life of the starter and does not require release of the recoil spring 110, which is an important safety feature.

The use of the cover 100 wherein the rope groove 72 and land 74 are substantially enclosed within skirt 114, aids in maintaining the rope on the pulley 42, even in those instances where the rope tension has been completely removed during recoiling such as when the operator allows rapid return of the handle 30. Also, the cover 100 is helpful in maintaining the excess rope upon the land 74 prior to the outer end of the starter rope being attached to the lawn mower handle console, and the use of the cover reduces assembly problems as well as alleviating problems pertaining to the alignment of the starter rope and pulley rope groove during recoiling.

In the disclosed embodiment the stop abutments 52 and 54 are located at approximately 180° relative to each other about the shaft 46. However, the angular spacing of these stop abutments may vary, depending on the amount of pulley rotation desired before the gear axial movement begins. Merely be relocating the stop abutments on bracket 38 the gear may be rotated only a few degrees to nearly 360° before friction restraint to rotation is imposed thereon.

It is appreciated that various modifications to the invention concepts may be apparent to those skilled in the art without departing from the spirit and scope of the invention.

We claim:

1. A rope starter for engines wherein the starter includes a pulley rotatable in a cranking direction and a rope recoiling direction having a helically splined connection with a driving member wherein relative rotation between the pulley and driving member causes the member to move axially toward and from engagement with a driven member and rotation of the driving member with the pulley upon engagement of the driving member with the driven member rotates the driven member when the pulley is rotating in the cranking direction, a friction brake selectively resisting rotation of the driving member and axial movement of the driving member, and friction brake restraining means selectively restraining the friction brake against rotation with the driving member, the improvement comprising, brake operation delay means interposed between the friction brake and the friction brake restraining means delaying operation of the friction brake when the pulley is initially rotated in the cranking direction until the pulley has rotated approximately one half of a revolution.

2. In a rope recoil starter as in claim 1 wherein the friction brake includes an extension substantially radially disposed to the axis of rotation of the pulley and driving member, and the friction brake restraining means comprises first and second fixed abutments angularly spaced from each other about the driving member axis of rotation, said friction brake extension rotating between said abutments for selective engagement therewith, said extension engaging said first abutment upon the pulley rotating in a cranking direction to restrain the friction brake against rotation and cause the driving member to move toward the driven member, and said extension engaging said second abutment upon the pulley rotating in a rope recoiling direction to restrain the friction brake against rotation and cause the driving member to move from engagement with the driven member, the extent of angular spacing between said abutments determining the extent of rotation of the pulley in the cranking direction prior to restraint of rotation of the friction brake and initiating movement of the driving member toward the driven member.

3. In a rope recoil starter as in claim 2, the friction brake comprising a resilient element frictionally embracing the driving member, said extension comprising a portion of said resilient element.

4. A rope recoil starter for engines comprising in combination, a mounting bracket for mounting the starter upon an engine, a shaft mounted upon said bracket and extending therefrom, a pulley rotatably mounted upon said shaft having an axially extending hub, a rope wound upon said pulley for rotating said pulley in a cranking direction, a recoil spring operatively associated with said pulley for rotating said pulley in a rope recoiling direction, helical splines defined upon said pulley hub, a driving member rotatively mounted upon said hub having complementary helical splines mating with said hub splines wherein relative rotation between said pulley and said driving member causes said member to move axially toward and from engagement with a driven member, rotation of said driving member with said pulley upon engagement of said driving member with said driven member rotating said driven member when said pulley is rotated in the cranking direction, said driving member moving toward said bracket when said pulley is rotated in the cranking direction, a friction brake frictionally mounted upon said driving member having an extension substantially radially disposed to the axis of rotation of said pulley and said driving member, first and second abutments defined upon said bracket extending from said bracket in a direction toward said driving member, said abutments being angularly spaced about said shaft, said friction brake extension rotating between said abutments for selective engagement therewith, said extension engaging said first abutment upon said pulley rotating in a cranking direction to restrain said friction brake against rotation and cause said driving member to move toward said driven member, said extension engaging said second abutment upon said pulley rotating in a rope recoiling direction to restrain said friction brake against rotation and cause said driving member to move from engagement with said driven member, the extent of angular spacing between said abutments about said shaft determining the extent of rotation of said pulley in the cranking direction prior to restraint of rotation of said friction brake when said pulley is initially rotated in the cranking direction.

5. In a rope recoil starter as in claim 4, said abutments being located on opposite sides of said shaft angularly spaced from each other about said shaft approximately 180°.

6. In a rope recoil starter as in claim 4, said abutments comprising elongated tabs homogeneously formed from the sheet metal of said bracket.

7. In a rope recoil starter as in claim 4, the friction brake comprising a resilient element frictionally embracing the driving member and said extension comprising a portion of said resilient element, a ridge defined on said bracket adjacent said second abutment extending toward the driving member, said ridge being in alignment with the axial projection of said friction brake extension with respect to the axis of rotation of the driving member and engaged by said extension when said extension is adjacent said second abutment preventing movement of the driving member toward said bracket and preventing inadvertent engagement of the driving and driven members after rotation of the pulley in the rope recoiling direction.

8. In a rope recoil starter as in claim 7, said ridge being of an elongated arcuate configuration and terminating short of said first abutment whereby said extension is misaligned with respect to said ridge when said extension engages said first abutment permitting the driving member to engage the driven member.

9. In a rope recoil starter as in claim 7, said ridge being of an inverted V-shaped configuration in transverse cross section.

* * * * *